US008136367B2

(12) United States Patent
Froelicher et al.

(10) Patent No.: US 8,136,367 B2
(45) Date of Patent: Mar. 20, 2012

(54) HINGE ASSEMBLY FOR A REFRIGERATOR

(75) Inventors: Steve B. Froelicher, Shepherdsville, KY (US); Matthew William Davis, Prospect, KY (US); Jeffrey Lynn Jessie, Taylorsville, KY (US); Amit Kurhekar, Bangalore (IN); Joseph Murphy Miller, Louisville, KY (US); John Joseph Roetker, Louisville, KY (US); Ronald Scott Tarr, Louisville, KY (US); Derek Lee Watkins, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 632 days.

(21) Appl. No.: 12/332,598

(22) Filed: Dec. 11, 2008

(65) Prior Publication Data

US 2010/0147007 A1 Jun. 17, 2010

(51) Int. Cl.

| | |
|---|---|
| ***F25C 1/22*** | (2006.01) |
| ***F25D 17/02*** | (2006.01) |
| ***F25D 11/02*** | (2006.01) |

(52) U.S. Cl. ..... 62/340; 62/185; 62/201; 62/443

(58) Field of Classification Search ..... 62/340, 62/448, 449, 465, 185, 201, 443; 222/146.6; 16/386

See application file for complete search history.

(56) References Cited

U.S. PATENT DOCUMENTS

| | | | | |
|---|---|---|---|---|
| 3,089,202 | A * | 5/1963 | Pulaski | 49/70 |
| 5,787,724 | A * | 8/1998 | Pohl et al. | 62/389 |
| 7,228,701 | B2 * | 6/2007 | Kim | 62/338 |
| 2004/0261450 | A1 * | 12/2004 | Yoshino et al. | 62/513 |
| 2008/0018212 | A1 * | 1/2008 | Spearing et al. | 312/236 |
| 2009/0089973 | A1 * | 4/2009 | Lee | 16/223 |

FOREIGN PATENT DOCUMENTS

KR 2008015341 A * 2/2008

* cited by examiner

*Primary Examiner* — Judy Swann
*Assistant Examiner* — Ignacio E Landeros
(74) *Attorney, Agent, or Firm* — Global Patent Operation; Douglas D. Zhang

(57) ABSTRACT

A hinge assembly and a refrigerator using the assembly are disclosed. The assembly rotatably mounts an access door for a compartment of the refrigerator to part of refrigerator that defines the compartment. The hinge assembly has a body coupled to the part and a hinge manifold supported by the body and slidably received in the access door. The manifold has a first supply conduit for supplying a working medium to an icemaker disposed in the access door and a first return conduit for returning the working medium from the icemaker. The hinge assembly can be manufactured as a separate module to be assembled with the refrigerator or retrofit into an existing refrigerator.

17 Claims, 7 Drawing Sheets

HINGE ASSEMBLY FOR A REFRIGERATOR

BACKGROUND OF THE INVENTION

The present invention relates generally to a hinge assembly and a refrigerator employing the hinge assembly. More particularly, the present invention relates to a hinge assembly providing a circulating route for a working medium used by a refrigerator and a refrigerator employing the hinge assembly.

Generally, a refrigerator includes a freezer compartment and a fresh food compartment which are partitioned from each other to store various foods at low temperatures in appropriate states for a relatively long time.

It is now common practice in the art of refrigerators to provide an automatic icemaker. In a "side-by-side" type refrigerator where the freezer compartment is arranged to the side of the fresh food compartment, the icemaker is usually disposed in the freezer compartment and delivers ice through an opening in the access door of the freezer compartment. In this arrangement, ice is formed by freezing water with cold air in the freezer compartment, the air being made cold by the cooling system or circuit of the refrigerator including an evaporator. In a "bottom freezer" type refrigerator where the freezer compartment is arranged below a top fresh food compartment, convenience necessitates that the icemaker is disposed in the access door of the top mounted fresh food compartment and delivers ice through an opening in the access door of the fresh food compartment, rather than through the access door of the freezer compartment. In this case, a working medium (i.e., coolant), such as air or a mixture of propylene glycol and water, is cooled, directly or indirectly, by the cooling system. The working medium is then delivered through a passageway to the icemaker to maintain the icemaker at a temperature below the freezing point of water.

Regardless of the type of the working medium, it would be desirable to provide a safe, compact, concealed and cost effective circulating scheme for supplying and returning the working medium to and from the icemaker from the main body of the refrigerator

BRIEF DESCRIPTION OF THE INVENTION

One aspect of the present invention relates to a hinge for rotatably mounting an access door for a compartment of a refrigerator to part of the refrigerator that defines the compartment. The hinge assembly includes a body coupled to the part and a hinge manifold supported by the body and slidably received in the access door. The hinge manifold has a first supply conduit for supplying a working medium to an icemaker disposed in the access door and a first return conduit for returning the working medium from the icemaker.

Another aspect of the present invention relates to a refrigerator. The refrigerator includes a first compartment, a second compartment separated from the first compartment by a mullion; an access door for selectively closing the second compartment; an icemaker disposed in the access door for producing ice; and a hinge assembly coupled to the mullion and the access door for rotatably mounting the access door to the second compartment. The door hinge assembly includes a first supply conduit for supplying a working medium to the icemaker and a first return conduit for returning the working medium from the icemaker.

Yet another aspect of the present invention relates to a method of circulating a working medium used in a refrigerator. The method includes supplying the working medium through a hinge of an access door of the refrigerator to an icemaker mounted on the access door, and returning the working medium from the icemaker through the hinge.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

FIG. 2 only schematically shows the hinge assembly;

DETAILED DESCRIPTION OF THE PREFERRED EMBODIMENTS OF THE INVENTION

It is contemplated that the teaching of the description set forth below is applicable to all types of refrigeration appliances, including but not limited to, household refrigerators. The present invention is therefore not intended to be limited to any particular refrigeration device or configuration described in the exemplary embodiments of the present invention.

Figure 1:
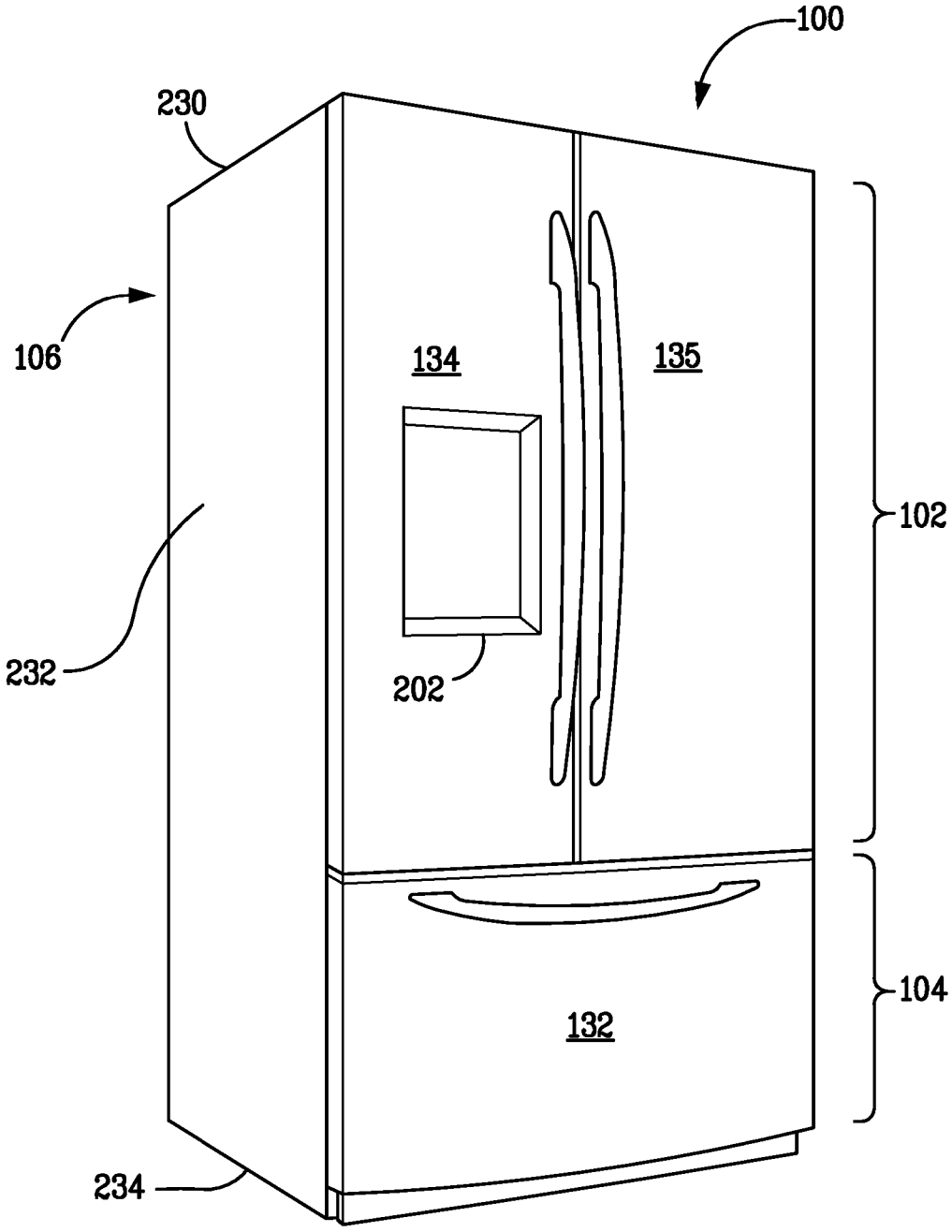
FIG. 1 is a perspective view of a refrigerator.
Figure 2:
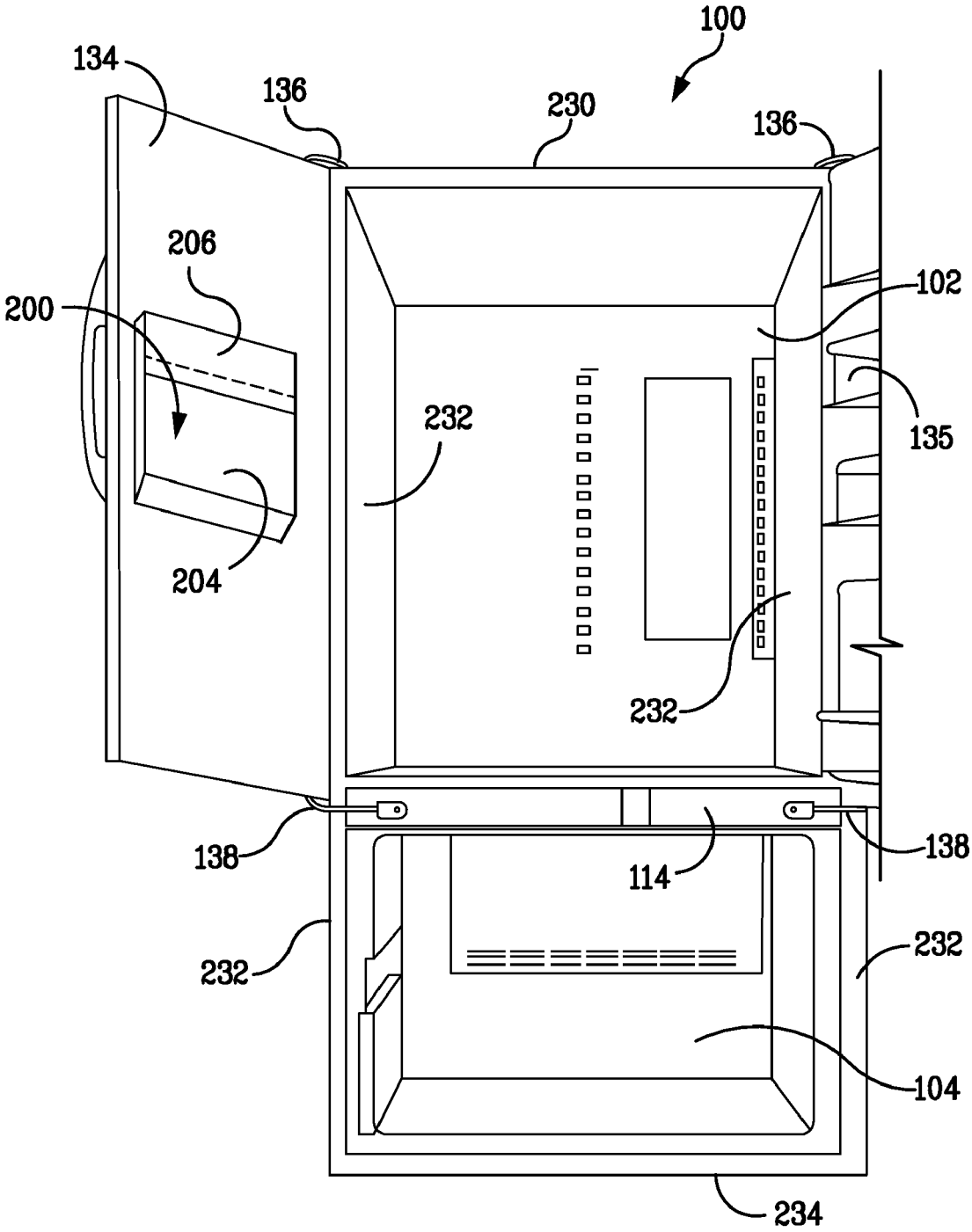
FIG. 2 is a perspective view of the refrigerator of FIG. 1 with the refrigerator doors open.

FIGS. 1 and 2 illustrate a bottom freezer type refrigerator 100, which includes a fresh food compartment 102 and a freezer compartment 104. The freezer compartment 104 and the fresh food compartment 102 are arranged in a bottom mount configuration where the freezer compartment 104 is disposed or arranged beneath or below the fresh food compartment 102. The fresh food compartment 102 is shown with French doors 134 and 135. However, it should be understood that a single access door can be used instead of the French doors 134, 135. The freezer compartment 104 is closed by a drawer or an access door 132.

The fresh food compartment 102 and the freezer compartment 104 are contained within a main body including an outer case 106. The outer case 106 can be formed by folding a sheet of a suitable material, such as pre-painted steel, into a generally inverted U-shape to form a top 230 and two sidewalls 232 of the outer case 106. A mullion 114, best shown in FIG. 2, which is for example formed of an extruded ABS material, connects the two sidewalls 232 to each other and separates the fresh food compartment 102 from the freezer compartment 104. The outer case 106 also has a bottom 234, which connects the two sidewalls 232 to each other at the bottom edges thereof, and a back (not shown). As is known in the art, a thermally insulating liner is affixed to the outer case 106.

The access door 132 and the French doors 134, 135 close access openings to the freezer compartment 104 and the fresh food compartment 102, respectively.

Each French door 134, 135 is mounted to the main body by a top hinge 136 and a corresponding bottom hinge 300, thereby being rotatable about the outer vertical edge of the fresh food compartment 102 between an open position for accessing the respective part of the fresh food compartment, as shown in FIG. 2, and a closed position for closing the respective part of the fresh food compartment, as shown in FIG. 1.

Similarly, when an access door 132 is used for the freezer compartment 104, it is rotatably attached to the main body in a known fashion. When a drawer is used for the freezer compartment, it is slidably received in the cavity defined by the sidewalls 232, the mullion 114 and the bottom 234 in a known fashion.

As illustrated in FIG. 2, an icemaker 200 for freezing water and automatically or selectively discharging ice is mounted on or in the French door 134 of the fresh food compartment 102. The icemaker 200 is preferably insulated to prevent or substantially reduce the undesired heat transfer between the icemaker 200 and the rest of the fresh food compartment 102. The icemaker 200 delivers ice from an opening 202 (shown in FIG. 1) formed on the exterior surface of the French door 134. The opening 202 faces away from the fresh food compartment 102 when the access door 134 is closed and is formed at a height facilitating convenient access to the ice.

The icemaker 200 includes an ice compartment 204 and an ice producing apparatus 206 installed in the ice compartment 204. Since the fresh food compartment 102 normally has a temperature higher than the freezing point of water, the ice producing apparatus 206 is generally connected or in flow communication with the freezer compartment 104 through an interior passageway or channel preferably collectively formed in the main body and the French door 134 to keep the icemaker 200 at a temperature lower than the freezing point of water.

Water in one or more ice molds (not shown) of the ice producing apparatus 206 is frozen into ice cubes, as is known in the art. The ice cubes may be discharged from the ice molds and stored in an ice storage bin disposed in the ice compartment 204 until needed by a user. The ice cubes may be withdrawn by accessing the ice storage bin through the opening 202. The ice cubes are usually dispensed by an ice-dispensing device (not shown) installed in the French door 134.

Figure 3:
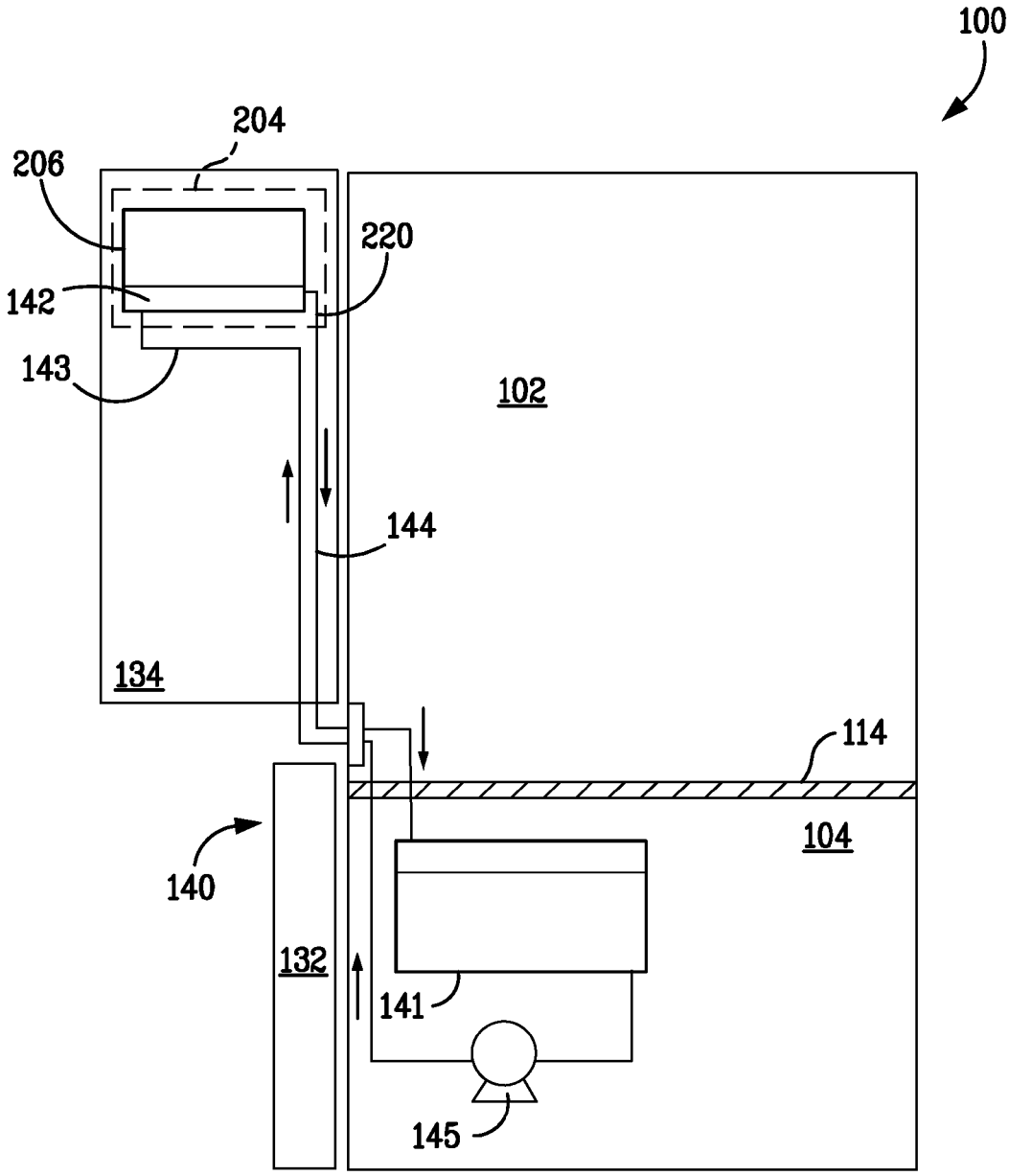
FIG. 3 is a schematic view, showing how a working medium is circulated within a second temperature control circuit and supplied to an icemaker mounted in the door of the refrigerator of FIG. 1.

The ice compartment must be cooled by a working medium, which is in turn cooled by at least one temperature control circuit of the refrigerator 100. The temperature control circuit can be a conventional vapor-compression refrigeration circuit. The vapor-compression refrigeration circuit is known in the art, and therefore will not be discussed in detail here. When the working medium is air, the temperature control circuit cools the air in the freezer compartment 104 to a predetermined temperature, and the cooled air is then supplied to the ice compartment 204 from the freezer compartment 104 through a supply air duct and then returned to the freezer compartment 104 through a return air duct. As illustrated in FIG. 3, when the working medium is a liquid, such as a food safe liquid in the nature of a mixture of propylene glycol and water, a second temperature control circuit 140 is used. The second temperature control circuit 140 includes a first heat exchanger 141 disposed in the freezer compartment 104, a second heat exchanger 142 mounted in the ice producing apparatus 206 and thermally coupled to the ice molds, a supply conduit 143 and a return conduit 144 between the first and second heat exchangers 141, 142, and a pump 145 for circulating the working medium within the second temperature control circuit 140. The working medium is cooled when it passes through the first heat exchanger 141. The pump 145 forces the cooled working medium to pass through the second heat exchanger 142 to keep the temperature of the ice producing apparatus 206 and/or the ice compartment 204 below the freezing point of water. The second temperature control circuit is discussed in greater detail in commonly owned application Ser. No. 11/958,900, filed Dec. 18, 2007, the entire content of which is incorporated herein by reference.

Figure 4:
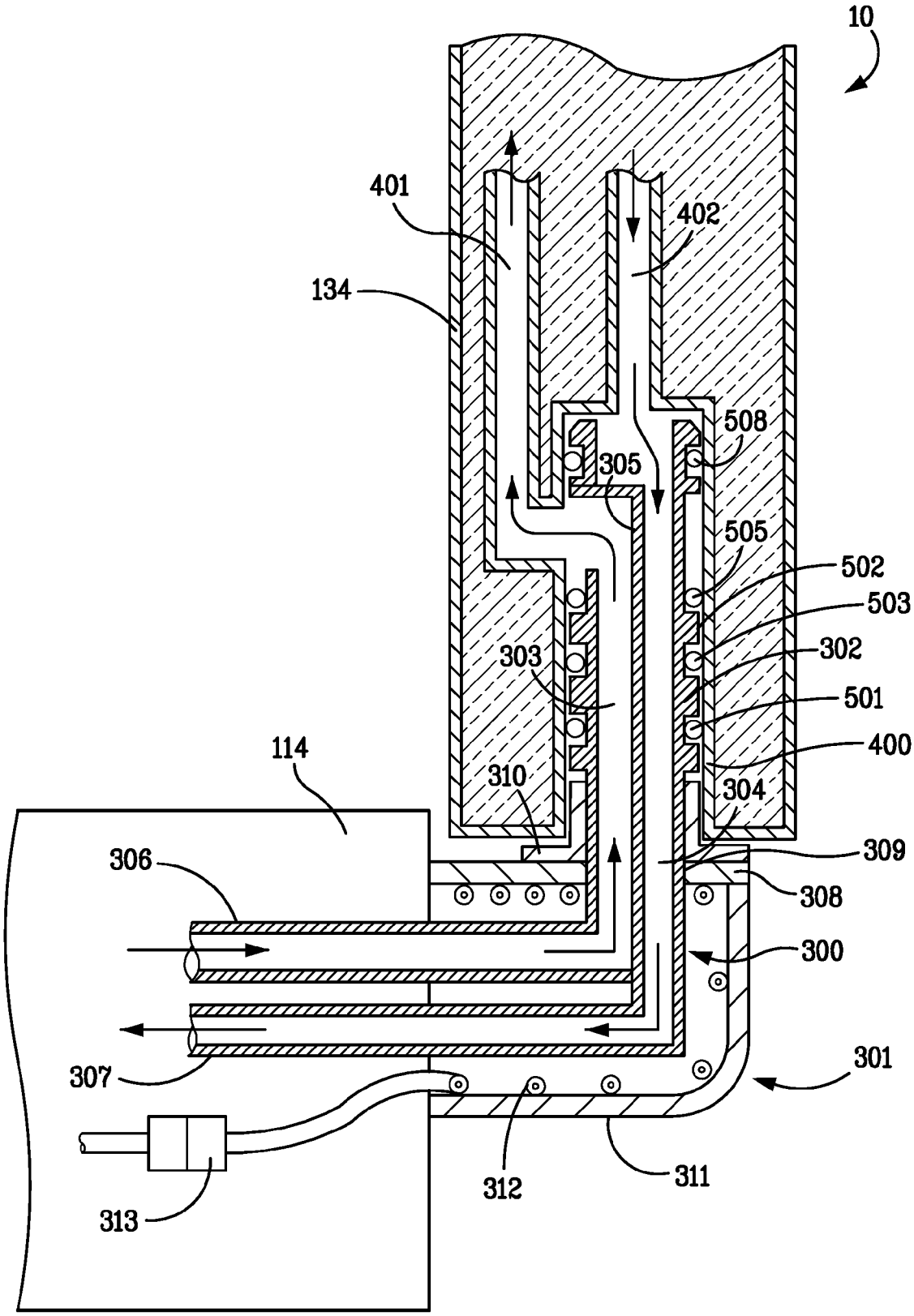
FIG. 4 an enlarged, partial sectional view of a hinge assembly according to an exemplary embodiment of the present invention.
Figure 5:
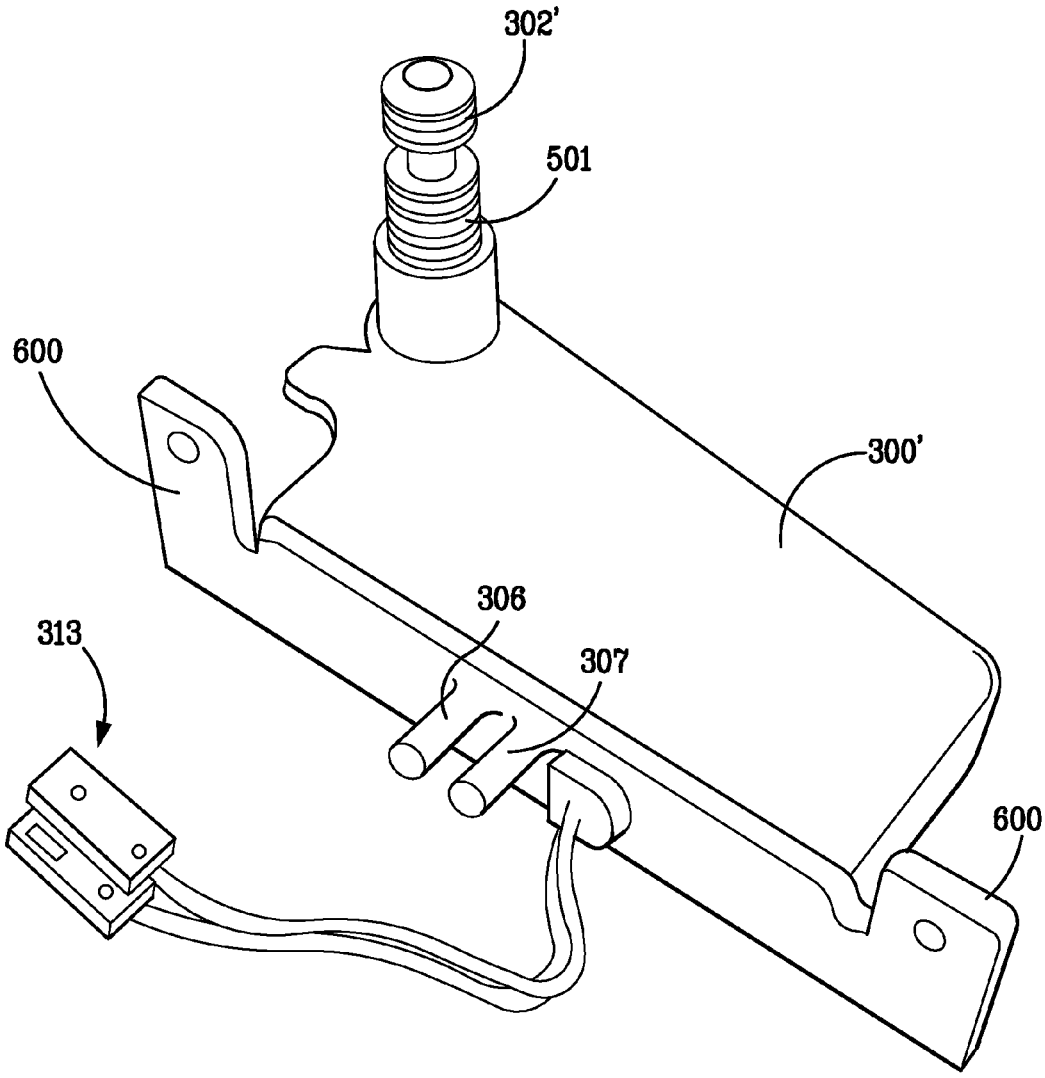
FIG. 5 is a perspective view of a modified hinge assembly.

FIGS. 4 and 5 illustrate details of hinge assembly 300, according to one exemplary embodiment of the present invention. The hinge assembly 300 is or replaces the bottom hinge 138 for the door 134 shown in FIG. 1.

The hinge assembly 300 includes a body 301 and a hinge manifold 302, which extends upwardly from the interior of the body 301 and is divided into a first supply conduit 303 and a first return conduit 304 by a common wall 305. For example, the hinge manifold 302 is a split manifold. The body 301 includes an inlet 306 and an outlet 307, which extend substantially horizontally from the interior of the body 301 and are in fluid or flow communication with the first supply conduit 303 and the first return conduit 304, respectively. In FIG. 4, the inlet 306 is shown disposed above the outlet 307. In FIG. 5, the inlet 306 and the outlet 307 are disposed side by side.

The first supply conduit 303 and the inlet 306 are used to transfer or conduct a working medium at a first predetermined temperature, such as −26° C. (−15° F.), to the ice producing apparatus 206. The first return conduit 304 and the outlet 307 are used to transfer or conduct the working medium at a second predetermined temperature, such as −23° C. (−10° F.), from the ice producing apparatus 206.

The hinge assembly 300 is fixed at the left side thereof (viewed in FIG. 3) to the mullion 114. (FIG. 5 shows the hinge assembly 300' is attached to the mullion 114 through a pair of supports 600 arranged at the ends of the hinge assembly 300'. The supports 600 can be screwed to the mullion 114. Other options, such as nailing or gluing, can also be used.) Once the hinge assembly 300 is fixed to the mullion 114, the inlet 306 and the outlet 307 are inserted into complementary receiving cavities (not shown) formed in the mullion 114 and further in fluid or flow communication with corresponding conduits (not shown) formed in the mullion 114, for the purpose of circulating the working medium. A seal (not shown) is preferably provided between each of the inlet 306 and the outlet 307 and its respective receiving cavities to prevent the working medium from leaking out.

The body 301 of the hinge assembly 300 includes a hinge plate 308 disposed under the door 134. For example, the hinge plate 308 is made of steel. It should be recognized that any suitable material is applicable. A through-hole 309 is formed in the hinge plate 308 to allow the hinge manifold 302 to extend upward from the body 301. The upper portion of the hinge manifold 302 is insertable into a substantially complementary door manifold 400 formed in the door 134. The hinge manifold 302 and the door manifold 400 are dimensioned to provide a suitable tight engagement, which is able to prevent the working medium from leaking out.

Once the hinge manifold 302 is inserted into the door manifold 400, the door 134 is rotatable about the hinge manifold 302. The hinge assembly 300 is further provided with a bearing 310 disposed between the door manifold 400 and the hinge manifold 302 to facilitate the rotation of the door 134. In addition, the bearing 310 maybe further disposed between the hinge plate 308 and the lower surface of the door 134.

The hinge manifold 302 can be made of suitable polymers, such as VALOX® resins. For example, the door manifold 400 can be made of High-Density Polyethylene (HDPE) and/or High Density Polypropylene (HDPP). It is contemplated that any other suitable material may be used instead of the foregoing described.

The door manifold 400 branches at the upper end thereof into a second supply conduit 401 and a second return conduit 402, which are in communication with the first supply conduit 303 and the first return conduit 304, respectively.

In order to provide a tight coupling between the hinge manifold 302 and the door manifold 400, at least one sealing element is applied between the hinge manifold 302 and the door manifold 400. For example, at least one o-ring seal 501 is disposed in a groove 502 formed along the outside of the hinge manifold 302. The o-ring seal 501 can be made from Ethylene Propylene Diene Monomer (EPDM). In addition, the material for the o-ring seal 501 may have a hardness of about Shore A 50, and can be peroxide cured. Moreover, the o-ring seal 501 may include 5% TPFE (tetrafluoroethylene), and further coated with grease of P 80 for lubrication.

It is contemplated that any other suitable material may be used for the o-ring seal 501 instead of the foregoing described. However, it should be noted that the life of the o-ring seal 501 should be robust to maintain a good performance of the hinge assembly 300. In addition, multiple o-ring seals can be used. FIG. 4 illustrates that three o-ring seals 501, 503 and 505 are disposed in respective grooves positioned at different locations of the hinge manifold 302.

As illustrated in FIG. 4, in order to separate the working medium in the supply conduits 303 and 401 from the working medium in the return conduits 304 and 402, an upper o-ring seal 508 is provided at the upper end of the hinge manifold 302.

The body 301 preferably has an outer cover 311, which, together with the hinge plate 308, provides an enclosure for the body 301. For example, the outer cover 311 is made of zinc. It should be recognized that any other suitable materials are applicable. The space within the body 301, which is not occupied by the hinge manifold 302, the inlet 306 and the outlet 307, or other conduits, is stuffed with a material having good heat isolation performance, such as foam. Similarly, the space within the door 134, which is not occupied by the door manifold 400, the second supply conduit 401, the second return conduit 402 or other conduits, is stuffed with a material having good heat isolation performance, such as foam.

In addition, a heating element such as an electric heater 312 is provided within the body 301, preferably adjacent to the outer cover 311. The heater 312 is powered through a power supply 313. When the heater 312 is actuated, warm convective air rises to bathe the outer cover 311, the lower surface of the door 134 and the bearing 310, thereby preventing the formation of condensation at those locations.

As illustrated in the drawings, the hinge assembly 300, 300' can be manufactured as a separate module, which can be assembled with the refrigerator as a subsystem or retrofit into an existing refrigerator. The whole structure is compact and allows easy removal of the access door when a field installation is required. All the conduits are not visible from outside, which improves the aesthetic aspect of the refrigerator.

Figure 6:
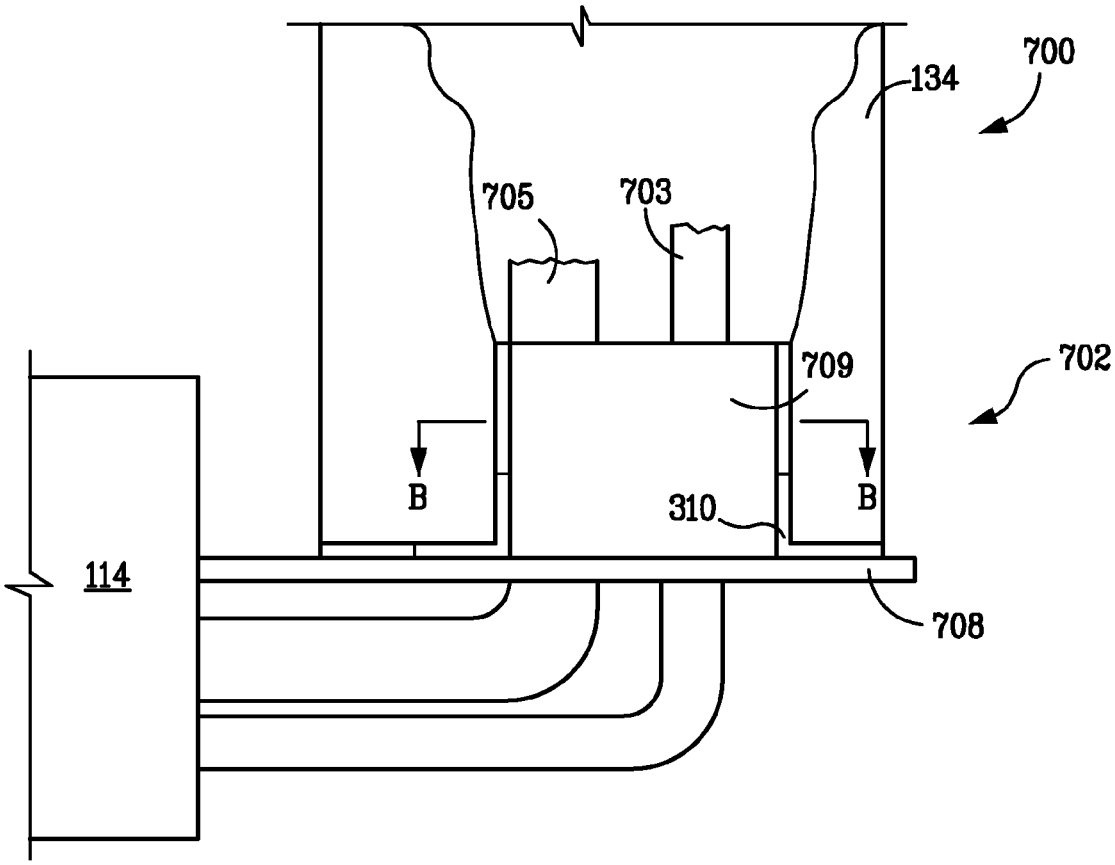
FIG. 6 is schematically side view, showing another inventive hinge assembly.
Figure 7:
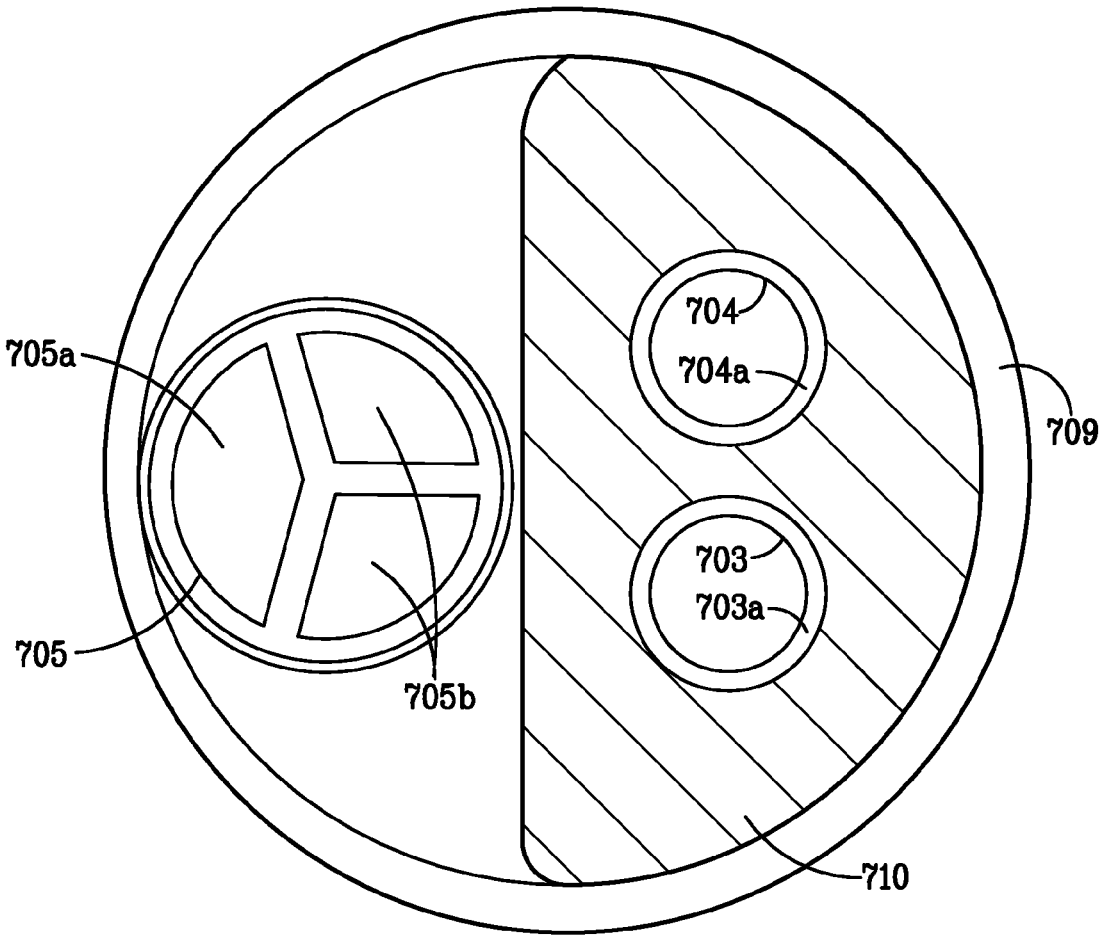
FIG. 7 is a partial view along lines B-B in FIG. 6.

FIGS. 6 and 7 show a hinge assembly 700 in accordance with another embodiment of the invention. The hinge assembly 700, which is used as a bottom hinge, includes a hinge manifold 702 and a hinge plate 708 attached to the mullion 114 and having a through hole (not shown). The hinge manifold 702 includes a hinge tube 709 extended upward from the hinge plate 708 and covering the hole. The hinge tube 709 is inserted into a cavity formed in the lower portion of the door 134 so that the door 134 is supported by the hinge assembly 700 and rotatable about the hinge tube 709. The bearing 310, which is shown in FIG. 4, can be disposed between the door 134 and the hinge manifold 702. The hinge manifold 702 also has a working medium supply conduit 703, a working medium return conduit 704, and a water conduit 705, all of which extend outward from the main body of the refrigerator 10, such as the mullion 114, and into the door 134 through the hinge tube 709. In FIG. 7, the water conduit 705 is shown as a multi-lumen tube having a drain tube 705*a* and two water supply tubes 705*b*. The drain tube 705*a* is used to direct water accumulated at the bottom of the ice compartment 204 to, for example, a tray mounted inside the main body of the refrigerator 10. The water supply tubes 705*b* are used to supply water to the ice producing apparatus 206 and a water dispenser mounted on the door 134. Of course, the drain tube 705*a* and the water supply tubes 705*b* can be formed as separated tubes which are spaced apart from each other. The supply conduit 703 and the return conduit 704 are shown as two separate conduits which are held in place inside the hinge tube 709 by a support bracket 710, but they (or at least the portions that pass through the hinge tube 709) can be combined as a multi-lumen tube. The supply conduit 703 preferably has a thermal insulation sleeve 703*a*, and a heating element such as a foil heater (not shown) wrapping around the thermal insulation sleeve 703*a*. Similarly, the return conduit 704 has a thermal insulation sleeve 704*a*, and a heating element such as a foil heater (not shown) wrapping around the thermal insulation sleeve 704*a*. The foil heaters are used to prevent the formation of condensation. Preferably, they cover at least the portions of the conduits 703, 704 that extend between the mullion 114 and the hinge plate 308. Like the embodiment shown in FIG. 4, a cover (not shown) and the hinge plate 708 form an enclosure covering the portions of the conduits 703, 704, 705 that extend between the mullion 114 and the hinge plate 308 so that these portions are concealed.

Thus, while there have shown and described and pointed out fundamental novel features of the invention as applied to various specific embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A hinge assembly for rotatably mounting an access door for a compartment of a refrigerator, the compartment being defined in part by a mullion, the hinge assembly comprising:

a body coupled to the mullion; and a hinge manifold supported by the body and slidably received in the access door, the hinge manifold comprising a first supply conduit for supplying a working medium to an icemaker disposed in the access door and a first return conduit for returning the working medium from the icemaker, wherein the first supply conduit and the first return conduit are in fluid communication with corresponding conduits formed in the mullion.

2. The hinge assembly of claim 1, wherein the hinge manifold is slidably received in a door manifold formed within the access door, the door manifold comprising a second supply conduit for supplying the working medium to the icemaker and a second return conduit for returning the working medium from the icemaker.

3. The hinge assembly of claim 2, wherein the first supply conduit and the first return conduit are in fluid communication with the second supply conduit and the second return conduit, respectively.

4. The hinge assembly of claim 2, further comprising at least one sealing element disposed between the door manifold and the hinge manifold.

5. The hinge assembly of claim 4, wherein the at least one sealing element comprises an o-ring seal.

6. The hinge assembly of claim 2, further comprising a bearing disposed between the door manifold and the hinge manifold.

7. The hinge assembly of claim 2, wherein the hinge manifold extends from an interior of the body to an exterior of the body.

8. The hinge assembly of claim 7, wherein the body comprises at least one heating element.

9. The hinge assembly of claim 8, wherein the body further comprises an outer cover, the at least one heating element being disposed adjacent to the outer cover.

10. The hinge assembly of claim 1, wherein the first supply conduit and the first return conduit are integrated to form a multi-lumen tube.

11. A refrigerator comprising:

a first compartment;

a mullion;

a second compartment separated from the first compartment by the mullion;

an access door for selectively closing the second compartment, the access door comprising a door manifold;

an icemaker disposed in the access door for producing ice; and a hinge assembly coupled to the mullion and the access door for rotatably mounting the access door to the second compartment, the hinge assembly comprising a hinge manifold, the hinge manifold defining therein a first supply conduit for supplying a working medium to the icemaker and a first return conduit for returning the working medium from the icemaker, wherein the door manifold defines therein a second supply conduit for supplying the working medium to the icemaker and a second return conduit for returning the working medium from the icemaker, and wherein the door manifold is configured to slidably and detachably receive the hinge manifold to fluidly connect the first supply conduit and the first return conduit to the second supply conduit and the second return conduit, respectively.

12. The refrigerator of claim 11, wherein the hinge assembly further comprises at least one sealing element disposed between the door manifold and the hinge manifold.

13. The refrigerator of claim 12, wherein the at least one sealing element comprises an o-ring seal.

14. The refrigerator of claim 11, wherein the hinge assembly further comprises a bearing disposed between the door manifold and the hinge manifold.

15. The refrigerator of claim 11, wherein the hinge assembly further comprises a body coupled to the mullion, the hinge manifold extending from an interior of the body to an exterior of the body.

16. The refrigerator of claim 15, wherein the body comprises at least one heating element.

17. The refrigerator of claim 16, wherein the body further comprises an outer cover, the at least one heating element being disposed adjacent to the outer cover.

* * * * *